United States Patent [19]

Hildt

[11] Patent Number: 4,695,845

[45] Date of Patent: Sep. 22, 1987

[54] THEFT-DETECTION WAFER ATTACHMENT SYSTEM INCLUDING SHIELD MEMBER

[76] Inventor: Earl H. Hildt, 2806 Glavin Way, Apt. E, Baltimore, Md. 21234

[21] Appl. No.: 786,592

[22] Filed: Oct. 11, 1985

[51] Int. Cl.[4] ..... H01Q 1/40

[52] U.S. Cl. ..... 343/873; 340/572

[58] Field of Search ..... 343/873; 411/511, 516, 411/517, 518, 519, 922; 340/258, 280, 572

[56] References Cited

U.S. PATENT DOCUMENTS

| | | | |
|---|---|---|---|
| 4,156,302 | 5/1979 | Van Niel | 340/572 |
| 4,187,509 | 2/1980 | Weiner | 343/873 |
| 4,253,084 | 2/1981 | Topputo | 340/572 |
| 4,590,461 | 5/1986 | Cooper | 340/572 |

*Primary Examiner*—Robert E. Wise

*Attorney, Agent, or Firm*—Cushman, Darby & Cushman

[57] ABSTRACT

A theft-detection wafer attachment system that increases the tamper-resistance of theft-detection wafers used in the retail apparel industry includes a disc-like theft-detection wafer of the type having a central projection for receiving a tack-like fastener and a concentric ridge that surrounded the projection. A shield member is mounted over the projection and includes a counterbore for receiving a tack-like fastener. The outside diameter of the shield member is less than the diameter of the concentric ridge to eliminate the opportunity to use the ridge as a fulcrum for prying the secured fastener from the wafer. Additionally, the counterbore receives the head of the fastener to deny access to the fastener head with a prying tool. The exposed portions of the shield member are preferably formed with tapered surface to prevent gripping with conventional gripping tools.

17 Claims, 7 Drawing Figures

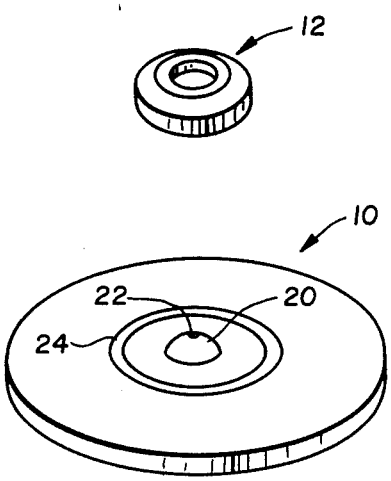
FIG. 1
FIG. 2 "PRIOR ART"
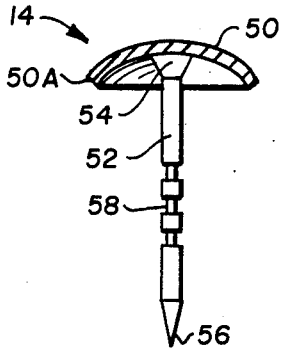
FIG. 3
"PRIOR ART"
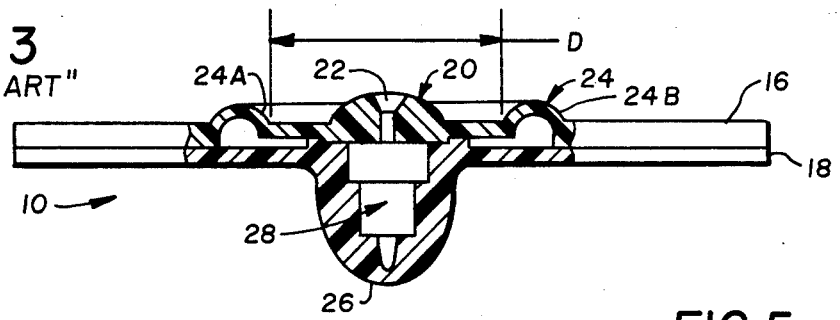
FIG. 4
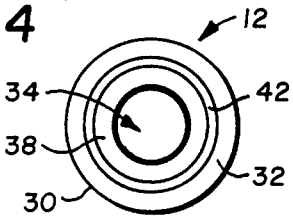
FIG. 5
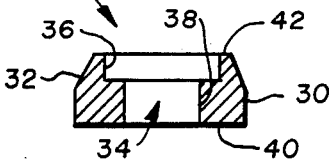
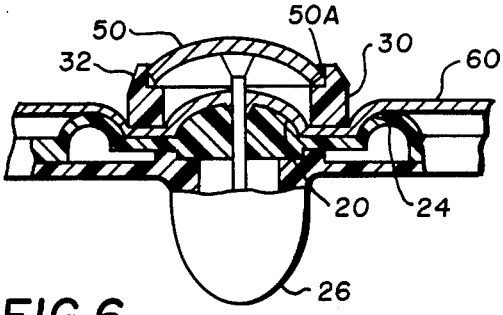
FIG. 6
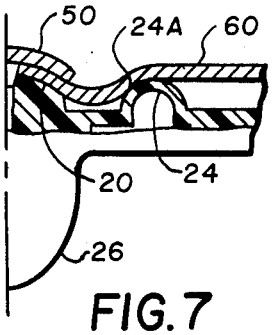
FIG. 7
"PRIOR ART"

THEFT-DETECTION WAFER ATTACHMENT SYSTEM INCLUDING SHIELD MEMBER

BACKGROUND OF THE INVENTION

The present invention relates generally to electronic theft detection devices and, more particularly, to the attachment of theft-detection devices to articles of merchandise to increase the tamper resistance of the device and to reduce the vulnerability cf the device to unauthorized removal.

Various devices and systems have been developed in the retail marketing industry for deterring shoplifters. In the retail clothing business, electronic theft detection systems are in common use. These systems typically employ a 'target' device, known in the art as a 'wafer', that is attached to an article of clothing using a releasable attachment system. Radio frequency interrogators are used to generate interrogation fields in or adjacent the shopping area exits. The target wafers generally include a resonant circuit which responds in some predetermined manner to the interrogation field to reliably detect an attempted unauthorized removal of the protected goods.

One such target wafer and attachment system is disclosed in U.S. Pat. No. 4,187,509, issued on Feb. 5, 1980 to A. Weiner for "Wafer and Fasteners for Use in Electronic Theft Detection System," the disclosure of which is incorporated herein by reference. The target wafer disclosed in the Weiner patent is formed as a flat plastic disc with a central hub-like projection and a concentric annular ridge that surrounds and is spaced from the projection. A tack-like fastener, which includes a domed or crowned head and a pointed shank, is releasably attached to the wafer by inserting the shank into a shank-receiving bore formed in the central projection. A gripping or locking device in the wafer holds the fastener securely in place until it is released using a specially designed releasing device.

The geometry of the dome-headed fastener and that of the wafer are such that the attachment of the fastener to the wafer is intended to be highly tamper-resistant. When the fastener is in its secured position, the dome-head cannot be easily gripped by conventional gripping tools, and the concentric ridge surrounding the fastener head generally limits the use a lever or other prying tool to pry the secured fastener from the wafer.

Theft prevention systems of the type disclosed in the Weiner patent have generally been effective for their intended purpose. However, determined thieves have developed compact tools which use the design configuration of the domed-headed fastener and concentric ridge to assist in the removal of fastener. More specifically, thieves have modified conventional screwdrivers by notching the tip of the screwdriver blade and bending the screwdriver blade over at an acute angle to create a miniature pry bar. The notched edge of the blade is held against the rim of the fastener head while the acutely bent portion of the screwdriver blade is positioned on the inwardly facing surface of the concentric ridge. When the distance between the notched tip and the acute bend in the screwdriver blade is properly formed, a substantial prying force can be applied against the fastener. The prying force can be applied to bend the head relative the shank or to lift the fastener relative the wafer to provide enough room for diagonal wire cutters to snip through the shank. Alternately, the prying force can be applied in a successive manner on opposite sides of the fastener head until the shank fractures. Thus, the concentric ridge formed on the wafer to deter tampering is used as a base or fulcrum to facilitate unauthorized removal of the fastener.

Since wafers and fasteners of the type disclosed in the Weiner patent are widely used in the retail apparel industry, any thief-developed tools that compromise the physical integrity of the secured fastener diminish the usefulness of the devices in deterring theft.

SUMMARY OF THE INVENTION

In view of the above, it is a primary object of the present invention, among others, to provide an improved fastening system for protective wafers of the type described above to increase the resistance of the fastened wafer to unauthorized removal.

It is another object of the present invention to provide an improved fastening system for protective wafers of the type described which eliminates any opportunity for engaging the edge of a fastener with a prying tool.

It is still a further object of the present invention to provide an improved fastening system for protective wafers of the type described which eliminates the opportunity to use the concentric ridge as a fulcrum for prying the fastener from the wafer.

In accordance with these objects, and others, the present invention provides an improved fastening system for theft-detection wafers of the type having a tack-like fastener that includes a head and a pointed shank and a theft-detection wafer having a projection with a shank-receiving bore and an concentric ridge that surrounds the projection and the head of the secured fastener. A shield member is mounted between the fastener and the wafer to prevent access to the edge of the fastener head and provide a circumferential barrier between the concentric ridge and the secured fastener. The shield member is formed as a circular body having a cylindrical outside diameter that is less than the inner diameter of the concentric ridge, a central bore that allows the shield member to be inserted over the projection that receives the fastener, and a counterbore for receiving the head of the fastener to prevent access to the edge of the fastener head with a prying tool. Additionally, the accessible portions of the shield member are formed with a tapered or conical surface to defeat attempts to grip the shield member with pliers or similar gripping tools.

The fastening system of the present invention advantageously increases the tamper-resistance of theft-detection wafers of the type described by precluding access to the peripheral edge of the head portion of the fastener and minimizing the opportunity to use the concentric ridge on the wafer as a fulcrum or base for a prying tool, particularly compact prying tools formed by modifying conventional screwdrivers. Additionally, the shield member presents a relatively wide surface area to the fabric retained between the shield member and the wafer to minimize the potential for damaging fabric secured between the shield member and the wafer.

A principal objective of the present invention is, therefore, the provision of an improved theft-detection wafer attachment system for theft-detection wafers of the type described in which the tamper resistance of the fastened wafer is greatly improved. Other objects and further scope of applicability of the present invention will become apparent from the detailed description to follow, taken in conjunction with the accompanying drawings, in which like parts are designated by like reference characters.

BRIEF DESCRIPTION OF THE DRAWING

FIG. 1 is a isometric view of a theft-detection wafer and a cooperating shield member;

FIG. 2 is an enlarged view, in partial cross section, of a fastener used with the theft-detection wafer and shield member of FIG. 1;

FIG. 3 is a partial cross sectional view, taken along a diameter line, of the theft-detection wafer of FIG. 1;

FIG. 4 is a top view of a shield member for use with the fastener and theft-detection wafer of FIGS. 1 and 2;

FIG. 5 is a side view, in cross section, of the shield member of FIG. 4;

FIG. 6 is a partial cross sectional view of a section of fabric secured between the fastener of FIG. 2 and shield member of FIGS. 4 and 5 and the theft-detection wafer of FIG. 3; and FIG. 7 is a partial side view, in cross section, of the prior fastening arrangement for the fastener and the theft-detection wafer.

DESCRIPTION OF THE PREFERRED EMBODIMENT

A theft-detection wafer attachment system in accordance with the present invention is shown in FIGS. 1 and 2 and includes a generally disc shaped wafer 10, a ring-like shield member 12, and, as shown in enlarged form in FIG. 2, a tack-like fastener 14.

The wafer 10, as shown in FIG. 3, is assembled from an upper member 16 that is secured to a lower member 18 with both members preferably formed from a moldable plastic. Typically, the upper and lower members 16 and 18 have a combined thickness of approximately 0.15 inches with an outside diameter of approximately 3.3 inches. The upper member 16 includes a central dome-like projection 20 that includes a shank-receiving bore 22, the function of which is described more fully below. A rounded, annular ridge 24 is formed on the upper member 16 and surrounds the projection 20. The ridge 24 is formed concentrically with the projection 20 and includes an inwardly facing surface 24A and an outwardly facing surface 24B. In the illustrated embodiment, the innermost edge of the of the inwardly facing surface 24A is formed at an inner diameter dimension D, approximately 1.020 inches in the illustrated embodiment. The lower member 18 includes a lock housing 26 in the form of a projection that is aligned axially with the projection 20. The interior of the lock housing 26 includes a cavity, generally designed at 28, in which a shank-locking mechanism (not shown) is mounted in axial alignment with the shank-receiving bore 22. The theft-detection wafer 10 also includes electrical circuitry that is responsive in a predetermined manner to a radio frequency interrogation field. Description of the electrical circuitry, the shank-locking mechanism, the materials, and the manner by which the wafer 10 is fabricated may be had by reference to the above-incorporated U.S. Pat. No. 4,187,509 to A. Weiner.

The shield member 12, as shown in FIGS. 4 and 5, is formed as a cylindrical member having an outside diameter surface 30, a conical upwardly facing surface 32, a central bore 34, a counterbore defined between a cylindrical surface 36 and an annular surface 38, a bottom surface 40, and an upper surface 42. As shown, the central bore 34 is formed coaxially with the counterbore defined by the surfaces 36 and 38. The shield member 12 is preferably molded from a high strength plastic, such as polycarbonate.

The fastener 14 is preferably fabricated from hardened steel and, as shown in FIG. 2, includes a domed head 50 having a peripheral rim 50A with a shank 52 connected to the concave underside of the head 50 through a frusto-conical transition section 54. The remote end of the shank 52 includes a pointed end 56, and the mid-section of the shank 52 is provides with a series of axially spaced grooves 58 that cooperate with the shank-locking mechanism 28 to releasably secure the fastener 14 to the wafer 10.

The wafer 10, the shield member 12, and the fastener 14 are dimensioned so that diameter of the counterbore defined by the cylindrical surface 36 of the shield member 12, 0.64 inches in the illustrated embodiment, is somewhat larger than the diameter of the head 50 of the fastener 14, and the diameter of the cylindrical surface 30 of the shield member 12, 1.015 inches, is somewhat less than the inner diameter D of the innermost edge of the inwardly facing surface 24A of the ridge 24. In addition, the diameter of the bore 34 is such that the shield member 12 fits over the projection 20 with enough clearance to accommodate at least one layer of fabric of the article to be protected, a diameter of 0.41 inches being preferred. The bore 34 is, of course, large enough to accommodate the shank 52 of the fastener 14. While the bore 34 is shown having a constant diameter along its length, the diameter can be varied provided the shank 52 can pass through shield member 12 to the shank-receiving bore 22 of the projection 20. The axial length of the cylindrical surface 36 should be long enough so the rim 50A of the fastener head 50, as described below, is completely contained with the counterbore, a length of 0.180 inches being preferred. The axial distance from the bottom surface 40 of the shield member 12 to the annular surface 38 should be enough to allow the shank 52 to accommodate fabrics of differing thickness, an axial distance of 0.165 being sufficient.

The wafer 10, shield member 12, and fastener 14 are secured to a fabric article of clothing, for example and as shown in FIG. 6, by laying the fabric 60 across the upper member 16, placing the shield member 12 over the fabric covered wafer 10 so that the fabric-covered projection 20 is positioned in the bore 34 with the fabric 60 conforming generally to the contour defined by the ridge 24, the bottom surface 40 of the shield member 12, and the projection 20. The pointed end 56 of the fastener 14 is past through the fabric 60 and into the shank-receiving bore 22 with the fastener 14 retained in place by the shank-locking mechanism 28. When the parts are assembled as described and shown in FIG. 6, the head 50 of the fastener 14 is contained with the counterbore defined by the surfaces 36 and 38 of the shield member 12 in such a way that the rim 50A of the head 50 is inaccessible and cannot be engaged by a prying tool. Since the outside diameter surface 30 is formed at a diameter (1.015 inches) that is somewhat less that the inner diameter D (1.020 inches) of the ridge 24, the shield member 12 occupies substantially all the surface area between the innermost edge of the inwardly facing surface 24A of the ridge 24 and the projection 20 so that opportunities to use the inwardly facing surface 24A or the crest of the ridge 24 as a fulcrum support are severly limited. The diameter of the surface 30 can be made smaller, although a smaller diameter may increase the availability of the inwardly facing surface 24A or the crest of the ridge 24 as a fulcrum support. Since the upwardly facing surface of the shield member 12 is defined as a conically tapered surface 32, the shield member 12 cannot be gripped by pliers or other gripping or pinching tools.

The advantages of the wafer attachment system of FIGS. 1–6 can be best appreciated by comparison with the prior attachment system disclosed in the above-incorporated U.S. Pat. No. 4,187,509 to Weiner as illustrated in FIG. 7. As shown, the fabric 60 is laid across the upper member 16 and the fastener 14 secured to the wafer 10 without the benefit of the above disclosed shield member 12. In the prior arrangement, the entire peripheral rim of the fastener head 50 and the inwardly facing surface 24A of the ridge 24 are accessible. Accordingly, a prying tool, as described above, can engage the rim of the fastener head 50 while using the inwardly facing surface 24A of the ridge 24 as a fulcrum support to allow the forcible lifting of the fastener 14 from the projection 20. The shield member 12 overcomes the disadvantages of the prior arrangement by providing a counterbore which receives the fastener head 50 to deny access to the rim 50A of the head 50 and by occupying substantially all the surface area between the innermost edge of the inwardly facing surface 24A of the ridge 24 and the projection 20 to thus minimize the opportunity to use the inwardly facing surface 24A or the crest of the ridge 24 as a fulcrum support for a prying tool. Since the lower surface 40 of the shield member 12 presents a relatively larger surface area to the fabric 60 compared to the fastener 50 of FIG. 7, the potential for damaging the fabric 60 in normal use is also reduced.

Thus it will be appreciated from the above that as a result of the present invention, a highly effective theft-detection wafer attachment system is provided by which the principal objective, among others, is completely fulfilled. It will be equally apparent and is contemplated that modification and/or changes may be made in the illustrated embodiment without departure from the invention. Accordingly, it is expressly intended that the foregoing description and accompanying drawings are illustrative of preferred embodiments only, not limiting, and that the true spirit and scope of the present invention will be determined by reference to the appended claims.

What is claimed is:

1. A theft-prevention wafer attachment system, comprising:

a fastener having a head and a shank connected to said head;

a theft detection element having a projection that includes a shank-receiving bore and having a ridge surrounding said projection, and means for releasably engaging a shank inserted into the shank-receiving bore; and a shield into the shank-receiving bore; and a shield member having a bore for accepting said head, said projection and having a counterbore for accepting said head, said shield member being proportioned so as to substantially fill the area on said theft detection element between said projection and said ridge, whereby said ridge cannot be used as a fulcrum to pry said fastener away from said theft detection element.

2. The theft-prevention wafer attachment system of claim 1, wherein said ridge is formed concentrically with said projection.

3. The theft-prevention wafer attachment system of claim 2, wherein:

the counterbore on said shield member is dimensioned to accept said head to deny access to the periphery of said head.

4. The theft-prevention wafer attachment system of claim 3, wherein said shield member is formed with an outside surface of revolution having a outside diameter dimension.

5. The theft-prevention wafer attachment system of claim 4, wherein said ridge is formed with an inner diameter dimension, the outside diameter dimension of said outside surface of revolution of said shield member being less than the inner diameter dimension of said ridge.

6. The theft-prevention wafer attachment system of claim 3, wherein said shield member is formed with outside surfaces of revolution including a cylindrical surface and a conical surface, the cylindrical surface formed having an outside diameter dimension.

7. The theft-prevention wafer attachment system of claim 6, wherein said ridge is formed with an inner diameter dimension, the outside diameter dimension of said outside cylindrical surface of revolution of said shield member being less than the inner diameter dimension of said ridge.

8. The theft-prevention wafer attachment system of claim 1, wherein said shield member is fabricated from a high-strength plastic.

9. The theft-prevention wafer attachment system of claim 8, wherein said high-strength plastic is polycarbonate.

10. A theft-detection wafer attachment system, comprising:

a fastener having a head and a pointed shank connected to said head;

a theft detection wafer having a projection that includes a shank-receiving bore and having a concentric ridge surrounding said projection, means for releasably engaging a shank inserted into the shank-receiving bore, and means for responding in a predetermined manner in the presence of an interrogation field; and a shield member having a bore for placement over and accepting said projection and having a counterbore for accepting said head, said shield member formed with an outside diameter less than the inner diameter dimension of said concentric ridge, whereby said concentric ridge cannot be used as a fulcrum to pry said fastener away from said theft detection wafer.

11. The theft-detection wafer attachment system of claim 10, wherein:

the counterbore of said shield member is dimensioned to accept said head to deny access to the periphery of said head.

12. The theft-detection wafer attachment system of claim 11, wherein said shield member is formed with outside surfaces of revolution including a cylindrical surface and a conical surface.

13. The theft-prevention wafer attachment system of claim 12, wherein said ridge is formed with an inner diameter dimension, the outside diameter dimension of said cylindrcal surface of revolution of said shield member being less than the inner diameter dimension of said ridge.

14. The theft-detection wafer attachment system of claim 11, wherein said shield member is fabricated from a high-strength plastic.

15. The theft-detection wafer attachment system of claim 14, wherein said plastic is polycarbonate.

16. A shield member for use with theft detection wafers and fasteners, the wafers of the type having a projection with a shank-receiving bore and a concentric ridge that surrounds the projection, a shank-locking means for releasably engaging a shank inserted into the shank-receiving bore, and means for responding in a predetermined manner to an interrogation field, the fastener of the type having a head and a pointed shank attached to the head, the shield member comprising:

a cylindrical body having a coaxially aligned bore and counterbore, the bore dimentioned to fit over the projection of the theft-detection wafer and the counterbore dimensioned to accept the head of the fastener so as to deny access to the rim portion of the fastener, the cylindrical body having an outside diameter less than the inner diameter of the concentric ridge, whereby the concentric ridge cannot be used as a fulcrum to pry the shank out of the shank receiving bore.

17. The shield member of claim 16, further comprising:

a conical upward facing outer surface.

* * * * *